US009104159B2

(12) United States Patent
Shiori et al.

(10) Patent No.: US 9,104,159 B2
(45) Date of Patent: Aug. 11, 2015

(54) IMAGE FORMING APPARATUS

(75) Inventors: Jun Shiori, Kanagawa (JP); Jun Yura, Kanagawa (JP); Yukiko Iwasaki, Kanagawa (JP); Masaki Sukesako, Kanagawa (JP); Hiroyuki Sugiyama, Kanagawa (JP); Kazuaki Kamihara, Tokyo (JP); Hironobu Takeshita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 199 days.

(21) Appl. No.: 13/207,949

(22) Filed: Aug. 11, 2011

(65) Prior Publication Data

US 2012/0045235 A1 Feb. 23, 2012

(30) Foreign Application Priority Data

Aug. 18, 2010 (JP) ..... 2010-182711

(51) Int. Cl.
*G03G 15/08* (2006.01)
*G03G 15/00* (2006.01)

(52) U.S. Cl.
CPC ..... *G03G 15/553* (2013.01); *G03G 15/55* (2013.01); *G03G 2215/0132* (2013.01)

(58) Field of Classification Search
CPC ..... G03G 15/553; G03G 15/55; G03G 2215/0132
USPC ..... 399/53
See application file for complete search history.

(56) References Cited

U.S. PATENT DOCUMENTS

| | | | | |
|---|---|---|---|---|
| 7,593,652 | B2 | 9/2009 | Takahashi et al. | |
| 7,676,164 | B2 | 3/2010 | Shiori et al. | |
| 7,734,200 | B2 | 6/2010 | Sugiyama et al. | |
| 8,301,045 | B2 * | 10/2012 | Ohshika | 399/43 |
| 8,374,517 | B2 * | 2/2013 | Nagatsuka | 399/43 |
| 2006/0204258 | A1 * | 9/2006 | Yamane | 399/44 |
| 2009/0279910 | A1 | 11/2009 | Shiori | |
| 2010/0329703 | A1 * | 12/2010 | Ozeki | 399/27 |
| 2011/0026958 | A1 | 2/2011 | Shiori | |
| 2012/0093528 | A1 * | 4/2012 | Shiori et al. | 399/43 |

FOREIGN PATENT DOCUMENTS

| | | |
|---|---|---|
| JP | 4-338780 | 11/1992 |
| JP | 2002-215005 | 7/2002 |
| JP | 2006-251504 | 9/2006 |
| JP | 4339281 | 7/2009 |
| JP | 2010-134407 | 6/2010 |

* cited by examiner

*Primary Examiner* — Ryan Walsh
*Assistant Examiner* — Philip Marcus T Fadul
(74) *Attorney, Agent, or Firm* — Oblon, McClelland, Maier & Neustadt, L.L.P.

(57) ABSTRACT

An image forming apparatus includes an image bearing member to bear a latent image on a surface thereof, a developing unit to develop the latent image on the image bearing member with toner, a driving unit to drive the developing device, a storage unit to store a cumulative travel distance of the developing roller at predetermined timing, a total travel distance of the developing unit, and control conditions for the developing unit, a controller to obtain a difference between the total travel distance of the developing roller and the cumulative travel distance up to a predetermined point in time in image forming operation and to instruct intermittent printing in which continuous printing is limited to a certain number of pages in a predetermined time period when the difference is equal to or greater than a threshold travel distance, and an operation unit in which the control conditions are set.

22 Claims, 6 Drawing Sheets

IMAGE FORMING APPARATUS

CROSS-REFERENCE TO RELATED APPLICATIONS

This patent application is based on and claims priority pursuant to 35 U.S.C. §119 from Japanese Patent Application No. 2010-182711, filed on Aug. 18, 2010 in the Japan Patent Office, which is hereby incorporated herein by reference in its entirety.

BACKGROUND OF THE INVENTION

1. Field of the Invention

Exemplary aspects of the present invention generally relate to an image forming apparatus, such as a copier, a facsimile machine, or a printer, and more particularly, to a developing unit that performs continuous printing and an image forming apparatus including the developing unit.

2. Description of the Background Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to make the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

When outputting a large number of recording media sheets for an extended period of time or image forming devices such as a fixing device and a developing unit are in operation for an extended period of time, the internal temperature of the image forming apparatus and the temperature of parts employed in the image forming apparatuses rise undesirably.

In order to prevent overheating of the image forming apparatus, generally, a cooling device such as a fan and a duct are employed to adjust the internal temperature. In particular, a high-speed image forming apparatus employs an air conditioner to adjust the internal temperature effectively.

When outputting small-size recording media sheets continuously, the temperature of a fixing roller employed in the fixing device where the recording media sheets do not come into contact rises locally. To address this difficulty, there is known an image forming apparatus that prevents irregular temperature of the fixing roller by monitoring the temperature of the fixing roller and extending temporarily intervals between the previous and the subsequent recording media sheets.

An amount of reduction in the internal temperature of the image forming apparatus by the known fan and the duct is limited due to the size and the internal configuration of the image forming apparatus, and arrangement of parts in the image forming apparatus. Furthermore, the temperature of the developing unit cannot be monitored directly so that the temperature of developer and sliding parts such as a shaft bearing in the developing unit increases significantly, melting undesirably toner in the developer.

In view of the above, a known approach includes reducing the temperature of a developing motor of the developing unit by calculating a change in the temperature of the developing motor and perform image forming processing intermittently when an estimated temperature of the developing motor reaches 100° C. or more. The image forming processing is performed intermittently until the temperature of the motor drops to 80° C. or less.

In this approach, the rise in the temperature is suppressed by calculating and estimating the temperature of the developing motor. However, the toner still melts in the developing unit.

In another approach, in a case in which a large amount of toner is consumed such as when a number of writing dots are equal to or greater than a threshold value, the image forming operation is performed intermittently to prevent toner from sticking to a toner regulation member (for example, a developing sleeve) that regulates a toner layer on the developing roller. Accordingly, the temperature of the toner (the toner layer) on the developing roller is reduced.

However, in a case in which the number of writing dots is small, the temperature of the developer and the sliding member such as the shaft bearing of the developing unit increases significantly. When this happens, the toner melts undesirably in the developing unit as well.

SUMMARY OF THE INVENTION

In view of the foregoing, in one illustrative embodiment of the present invention, an image forming apparatus includes an image bearing member, a developing unit, a driving unit, a storage unit, a controller, and an operation unit. The image bearing member bears a latent image on a surface thereof. The developing unit includes a developing roller facing the image bearing member and develops the latent image formed on the image bearing member using toner to form a toner image. The driving unit drives the developing roller. The storage unit stores a cumulative travel distance of the developing unit at predetermined timing, a total travel distance of the developing unit, and control conditions for the developing unit. The controller obtains a difference between the total travel distance of the developing roller and the cumulative travel distance up to a predetermined point in time in image forming operation and instructs intermittent printing in which continuous printing is limited to a certain number of pages in a predetermined time period when the difference is equal to or greater than a threshold travel distance. The control conditions are set in the operation unit.

In another illustrative embodiment of the present invention, an image forming apparatus includes means for bearing a latent image, means for developing the latent image using toner to form a toner image including a developing roller facing the image bearing means, means for driving the developing roller, means for storing a cumulative travel distance of the developing means at predetermined timing, a total travel distance of the developing means, and control conditions for the developing unit, means for obtaining a difference between the total travel distance of the developing means and the cumulative travel distance of the developing means up to a predetermined point in time in image forming operation, means for instructing intermittent printing in which continuous printing is limited to a certain number of pages in a predetermined time period when the difference is equal to or greater than a threshold distance, and means for setting the control conditions.

In yet another illustrative embodiment of the present invention, an image forming method for forming an image includes bearing a latent image, developing the latent image using toner to form a toner image, driving a developing unit, storing a cumulative travel distance of the developing unit at predetermined timing, a total travel distance of the developing unit, and control conditions for the developing unit, obtaining a difference between the total travel distance of the developing unit and the cumulative travel distance of the developing unit up to a predetermined point in time in image forming operation, instructing intermittent printing in which continuous printing is limited to a certain number of pages in a predetermined time period when the difference is equal to or greater than a threshold travel distance, and setting the control conditions.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
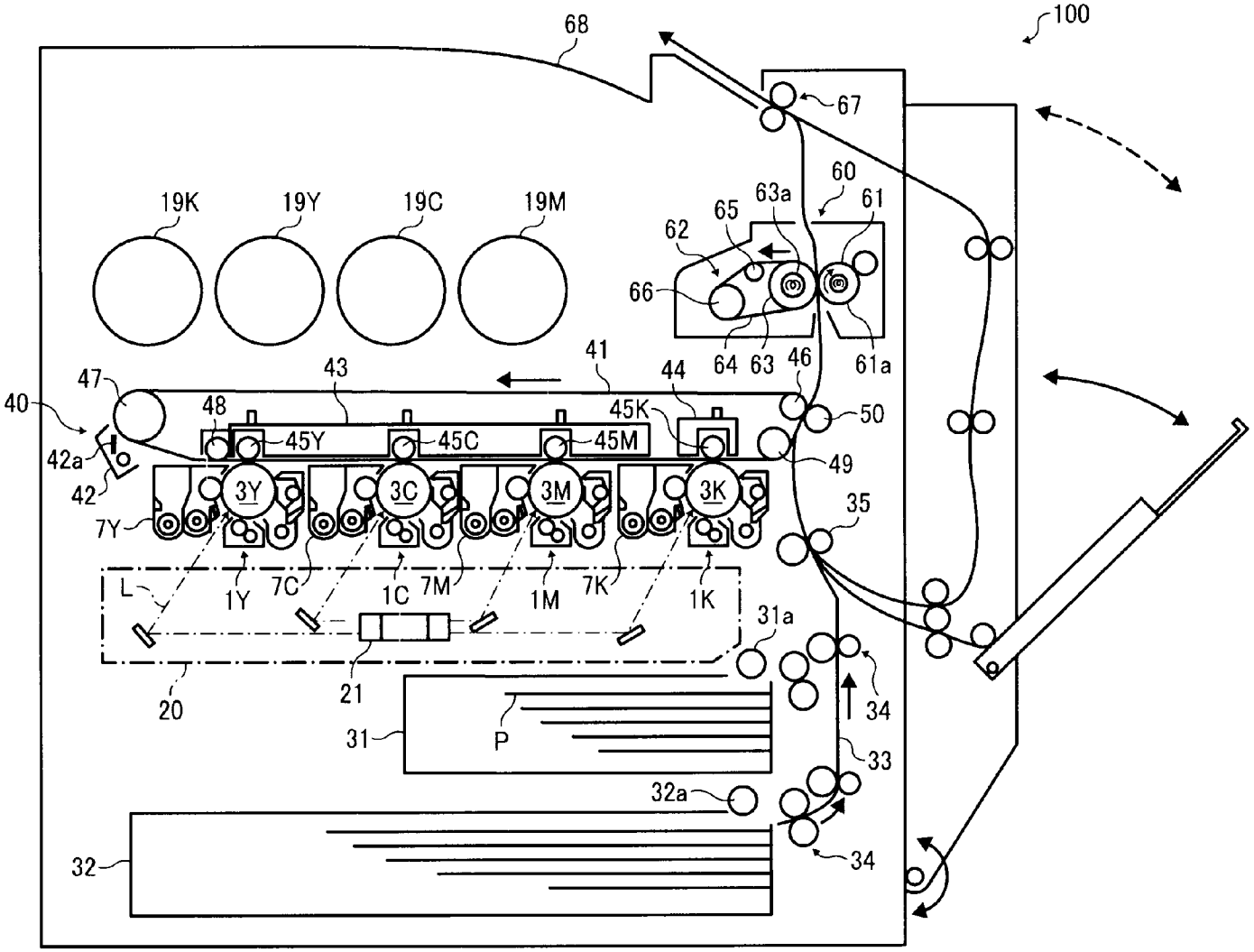
FIG. 1 is a schematic diagram illustrating an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the teems "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating a printer as an example of an image forming apparatus according to an illustrative embodiment of the present invention.

As illustrated in FIG. 1, an image forming apparatus 100 is a printer and includes four image forming units 1Y, 1C, 1M, and 1K for forming toner images of yellow, cyan, magenta, and black, respectively. It is to be noted that the suffixes Y, C, M, and K denote colors yellow, cyan, magenta, and black, respectively. To simplify the description, these suffixes are omitted herein, unless otherwise specified. The image forming units 1Y, 1C, 1M, and 1K all have the same configuration as all the others, differing only in the color of toner employed. Thus, a description is provided of the image forming unit 1Y as an example of the image forming units.

The image forming unit 1Y includes a photoconductive drum assembly 2Y (illustrated in FIG. 2) and a developing unit 7Y. The photoconductive drum assembly 2Y and the developing unit 7Y are removably installable as a single integrated unit as the image forming unit 1Y relative to the image forming apparatus 100. It is to be noted that the developing unit 7Y can be separated from the photoconductive drum assembly 2Y once removed from the image forming apparatus 100.

An optical writing unit 20 is disposed substantially below the image forming units 1Y, 1C, 1M, and 1K. The optical writing unit 20 illuminates photoconductive drums 3Y, 3C, 3M, and 3K of the image forming units 1Y, 1C, 1M, and 1K with a light beam L based on image information. The photoconductive drums 3Y, 3C, 3M, and 3K, one for each of the colors yellow, cyan, magenta, and black, are arranged in tandem facing an intermediate transfer belt 41. Accordingly, electrostatic latent images are formed on the photoconductive drums 3Y, 3C, 3M, and 3K.

The optical writing unit 20 includes a polygon mirror 21, a plurality of optical lenses and mirrors, and a light source which projects the light beam L. The light beam L projected from the light source is deflected by the polygon mirror 21, thereby scanning the photoconductive drums 3Y, 3C, 3M, and 3K. The optical writing unit 20 may employ an LED array to scan the photoconductive drums.

A first sheet cassette 31 and a second sheet cassette 32 are stacked in a vertical direction substantially below the optical writing unit 20. Each of the first sheet cassette 31 and the second sheet cassette 32 stores a stack of recording media sheets P. The first sheet cassette 31 includes a first sheet feed roller 31*a* that contacts a top sheet of the recording media sheets in the first sheet cassette 31. The second sheet cassette 32 includes a second sheet feed roller 32*a* that contacts a top sheet of the recording media sheets in the second sheet cassette 32.

As the first sheet feed roller 31*a* is rotated in a counterclockwise direction by a driving device, not illustrated, picking up the top sheet in the first sheet cassette 31, the top sheet is sent to a sheet feed path 33. The sheet feed path 33, extending vertically, is provided to the right of the sheet feed cassette 31. As the second sheet feed roller 32*a* is rotated in the counterclockwise direction by the driving device, not illustrated, picking up the top sheet in the second sheet cassette 32, the top sheet is sent to the sheet feed path 33.

A plurality of a pair of sheet transport rollers 34 is provided in the sheet feed path 33, to sandwich and transport the recording medium P upward. Substantially at the end of the sheet feed path 33, a pair of registration rollers 35 is provided. The recording medium P sent from the pair of the sheet transport rollers 34 is sandwiched by the pair of the registration rollers 35 and stopped temporarily. The recording medium P is fed to a secondary transfer nip defined by a secondary transfer backup roller 46 and a secondary transfer roller 50 opposite the secondary backup roller 46 via the intermediate transfer belt 41 in appropriate timing such that the recording medium P is aligned with a toner image formed on the recording medium P.

A transfer unit 40 serving as a transfer device is disposed substantially above the image forming unit 1Y, 1C, 1M, and 1K. The transfer unit 40 includes the intermediate transfer belt 41, a belt cleaning device 42, a first bracket 43, a second bracket 44, and so forth. The intermediate transfer belt 41 is wound around a plurality of rollers and formed into a loop so that it rotates endlessly in the counterclockwise direction. The transfer unit 40 includes also primary transfer rollers 45Y, 45C, 45M, and 45K, the secondary transfer backup roller 46, a driving roller 47, an auxiliary roller 48, and a tension roller 49. The intermediate transfer belt 41 is wound around these rollers. Rotation of the driving roller 47 enables the intermediate transfer belt 41 to rotate endlessly in the counterclockwise direction.

The photoconductive drums 3Y, 3C, 3M, and 3K contact the primary transfer rollers 45Y, 45C, 45M, and 45K via the intermediate transfer belt 41, thereby forming primary transfer nips therebetween. The inner surface of the intermediate transfer belt 41 is supplied with a transfer bias having a polarity (for example, a positive polarity) that is opposite the polarity of toner. As the intermediate transfer belt 41 rotates passing through the primary transfer nips for the colors yellow, cyan, magenta, and black, toner images of the colors yellow, cyan, magenta, and black formed on the photoconductive drums 3Y, 3C, 3M, and 3K are primarily transferred onto the intermediate transfer belt 41 so that they are superimposed one atop the other, thereby forming a composite toner image.

The secondary transfer backup roller 46 is disposed opposite the intermediate transfer roller 50 disposed outside the loop formed by the intermediate transfer belt 41, thereby forming the secondary transfer nip. As described above, rotation of the pair of registration rollers 35 resumes and sends the recording medium P to the secondary transfer nip in appropriate timing such that the recording medium P is aligned with the composite toner image formed on the intermediate transfer belt 41. The composite toner image on the intermediate transfer belt 41 is secondarily transferred onto the recording medium P in the secondary transfer nip by the nip pressure and a secondary transfer electric field generated between the secondary transfer roller 50 and the secondary transfer backup roller 46. Accordingly, the full-color toner image is formed on the recording medium P.

Residual toner remaining on the intermediate transfer belt 41, not having been transferred onto the recording medium P after the secondary transfer, is cleaned by the belt cleaning device 42. The belt cleaning device 42 includes a cleaning blade 42*a* which contacts the outer surface of the intermediate transfer belt 41 to remove the residual toner on the intermediate transfer belt 41.

Substantially above the secondary transfer nip, a fixing unit 60 is disposed. The fixing unit 60 includes a pressing roller 61 serving also as a heating roller and a fixing belt assembly 62. The pressing roller 61 includes a heat source 61*a* such as a halogen lamp inside thereof. The fixing belt assembly 62 includes a fixing belt 64 serving as a fixing member, a heating roller 63, a tension roller 65, a driving roller 66, and so forth. The heating roller 63 includes a heat source 63*a* such as a halogen lamp inside thereof. The fixing belt 64 is wound around the heating roller 63, the tension roller 65, and the driving roller 66 and formed into a loop. The fixing belt 64 rotates endlessly in the counterclockwise direction.

The heating roller 63 is disposed inside the loop formed by the fixing belt 64 and opposite the pressing roller 61. As the fixing belt 64 rotates, the fixing belt 64 is heated by the heating roller 63 from inside the loop. The pressing roller 61 rotating in the clockwise direction contacts the heating roller 63 from the outside the loop via the fixing belt 64, thereby forming a fixing nip.

Outside the loop formed by the fixing belt 64, a temperature detector, not illustrated, is disposed substantially near the fixing belt 64 with a predetermined space therebetween. The temperature detector detects the surface temperature of the fixing belt 64. Results of detection are provided to a fixing power circuit, not illustrated. Based on the results provided by the temperature detector, the fixing power circuit controls power supply for the heat source 63*a* of the heating roller 63 and the heat source 61*a* of the pressing roller 61. With this configuration, the surface temperature of the fixing belt 64 is maintained at approximately 140° C.

After passing through the secondary transfer nip, the recording medium P separates from the intermediate transfer belt 41 and is sent to the fixing unit 60. As the recording medium P is transported upward and passes through the fixing nip in the fixing unit 60, the composite toner image on the recording medium P is pressed and heated by the fixing belt 64 and the pressing roller 61. Accordingly, the composite toner image is fixed on the recording medium P. After the composite toner image is fixed, the recording medium P is discharged outside the image forming apparatus 100 through a pair of sheet discharge rollers 67.

The image forming apparatus 100 includes a sheet stack portion 68 on the upper plane of image forming apparatus 100. The recording medium P discharged by the pair of the sheet discharge rollers 67 is stacked on the sheet stack portion 68.

Substantially above the transfer unit 40, four toner cartridges 19Y, 19C, 19M, and 19K, one for each of the colors yellow, cyan, magenta, and black, are arranged to store respective colors of toner. The toner cartridges 19Y, 19C, 19M, and 19K supply toner to the developing unit 7Y, 7C, 7M, and 7K of the image forming units 1Y, 1C, 1M, and 1K. The toner cartridges 19Y, 19C, 19M, and 19K are removably installable independently from the image forming units 1Y, 1C, 1M, and 1K.

Figure 2:
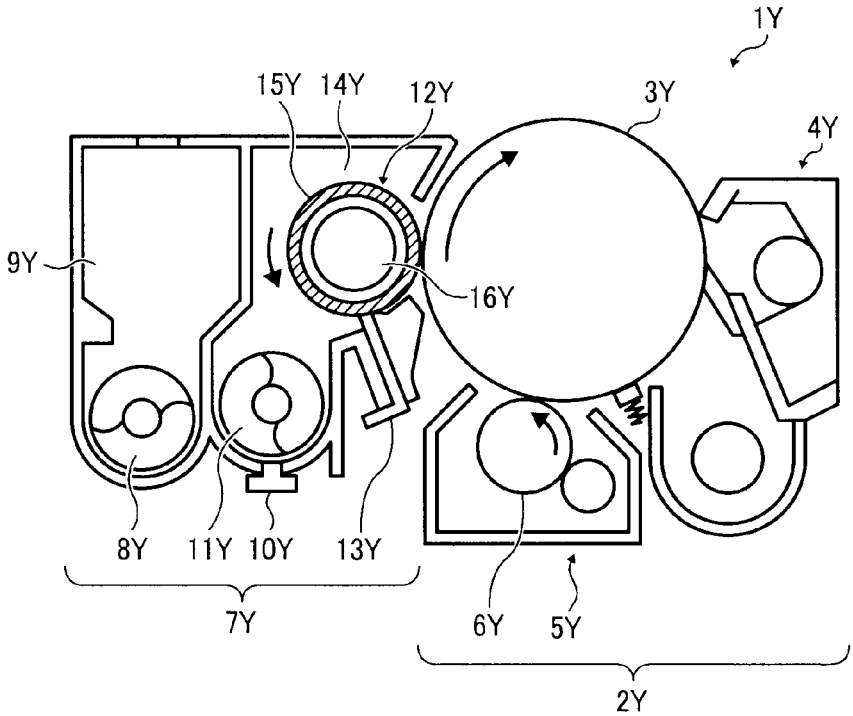
FIG. 2 is a schematic diagram illustrating an image forming unit for the color yellow as an example of the image forming units according to an illustrative embodiment of the present invention.
Figure 3:
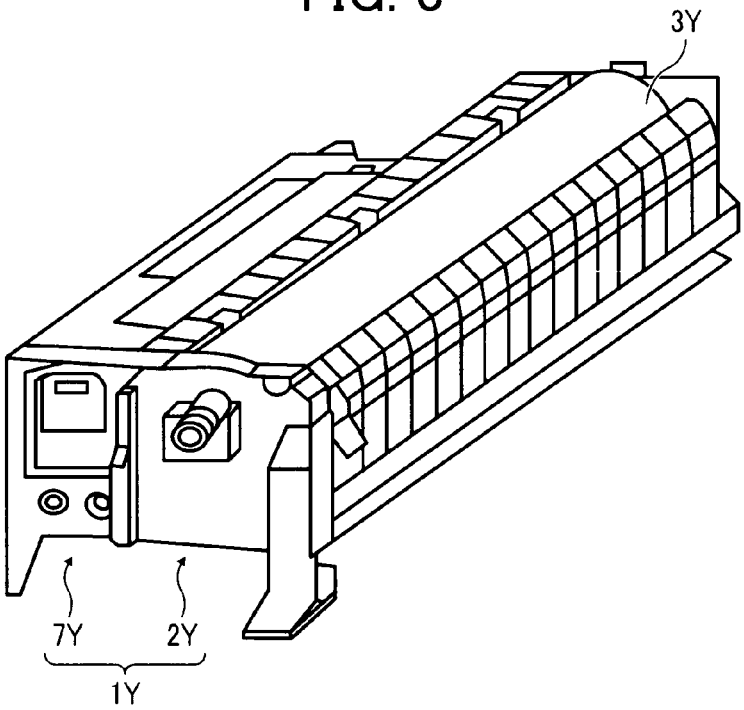
FIG. 3 is a schematic perspective view of the image forming unit of FIG. 2.

With reference to FIGS. 2 and 3, a description is provided of the image forming unit 1Y. FIG. 2 is a schematic diagram illustrating the image forming unit 1Y for the color yellow according to an illustrative embodiment of the present invention. FIG. 3 is a schematic perspective view of the image forming unit 1Y.

The image forming unit 1Y includes the photoconductive drum assembly 2Y and the developing unit 7Y. The photoconductive drum assembly 2Y includes the photoconductive drum 3Y serving as a latent image bearing member, a drum cleaner 4Y, a charge neutralizer, not illustrated, and a charger 5Y. The charger 5Y includes a charging roller 6Y that charges uniformly the photoconductive drum 3Y rotating in the clockwise direction indicated by an arrow in FIG. 2. The charging roller 6Y is supplied with a charging bias from a power source, not illustrated. As the charging roller 6Y is moved to the photoconductive drum 3Y, the photoconductive drum 3Y is charged uniformly.

According to the illustrative embodiment, a roller-type charging device (charging roller 6Y) is used. Alternatively, a brush-type charging device (charging brush) may be used. In such a case, the charging brush contacts the photoconductive drum 3Y. The photoconductive drum 3Y may be charged using a charger, such as a scorotron charger.

The surface of the photoconductive drum 3Y charged by the charger 5Y is exposed and scanned by the laser beam L projected from the optical writing unit 20, thereby forming an electrostatic latent image for the color yellow on the photoconductive drum 3Y.

The developing unit 7Y includes a first developer chamber 9Y and a second developer chamber 14Y. The first developer chamber 9Y includes a first conveyance screw 8Y. The second developer chamber 14Y includes a toner density detector 10Y, a second conveyance screw 11Y, a developing roller 12Y, a doctor blade 13Y, and so forth. The first developer chamber 9Y and the second developer chamber 14Y include a yellow developer, not illustrated, consisting of magnetic carrier and negatively charged yellow toner. The first conveyance screw 8Y is rotated by a drive source, not illustrated, to transport the developer from a proximal side to a distal side in the first developer chamber 9Y, that is, in a direction perpendicular to a surface of FIG. 2.

The first developer chamber 9Y and the second developer chamber 14Y are segregated by a wall including a connecting hole, not illustrated. The developer Y is transported from the first developer chamber 9Y to the second developer chamber 14Y through the hole. The second conveyance screw 11Y in the second developer chamber 14Y is rotated to transport the developer Y from a proximal side to a distal side in the second developer chamber 14Y. While being transported, the density of toner in the developer Y is detected by the toner density detector 10Y which is fixed to the bottom of the first developer chamber 14Y.

Substantially above the second conveyance screw 11Y, the developing roller 12Y is disposed such that the developing roller 12Y is parallel to the second conveyance screw 11Y. The developing roller 12Y includes a developing sleeve 15Y formed of a nonmagnetic pipe that rotates in the counterclockwise direction. Inside the developing sleeve 15Y, a magnet roller 16Y is disposed. A portion of the developer Y transported by the second conveyance screw 11Y is attracted to the surface of the developing sleeve 15Y serving as a developing member due to the magnetic force of the magnet roller 16Y, thereby forming a toner layer on the developing sleeve 15Y.

The doctor blade 13Y spaced a part a certain distance relative to the developing sleeve 15Y regulates the thickness of the toner layer on the developing sleeve 15Y. Subsequently, the regulated toner layer on the developing sleeve 15Y faces the photoconductive drum 3Y and adhered to the electrostatic latent image on the photoconductive drum 3Y, thereby forming a toner image of yellow on the photoconductive drum 3Y.

After the developing process, the developer from which the toner is consumed is returned to the second conveyance screw 11Y as the developing sleeve 15Y rotates. As the developer is transported to the proximal side in FIG. 2, the developer returns to the first developer chamber 9Y through the hole.

The magnetic permeability of the developer Y detected by the toner density detector 10Y is provided to a controller, not illustrated, as a voltage signal. In order to indicate a correlation with the density of toner in the developer Y, the magnetic permeability of the developer Y detected by the toner density detector 10Y is output as a voltage corresponding to the density of the toner.

The controller includes a RAM. The RAM stores Vtref for yellow which is a target value for an output voltage from the toner density detector 10Y. The RAM also stores Vtref for cyan, Vtref for magenta, and Vtref for black. As for the developing unit 7Y, the output voltage from the toner density detector 10Y is compared to the Vtref for yellow, and then a toner supply device for yellow is operated for a certain duration in accordance with the result of comparison. Accordingly, a proper amount of yellow toner is supplied to the developer in the first developer chamber 9Y in which the yellow toner has been consumed during development and hence the density toner has been reduced. As a result, the density of toner in the second developer chamber 14Y is maintained within a permissible range.

Similar to the developer of the image forming unit 1Y, the same toner supply operation is performed in the image forming units 1C, 1M, and 1K.

The toner image Y formed on the photoconductive drum 3Y is transferred onto the intermediate transfer belt 41. After the toner image is transferred, residual toner remaining on the photoconductive drum 3Y is cleaned by the drum cleaner 4Y. Subsequently, a charge neutralizer, not illustrated, removes charge on the photoconductive drum 3Y so that the surface of the photoconductive drum 3Y is initialized in preparation for the subsequent imaging cycle.

Similar to the image forming unit 1Y, the toner images are formed on the photoconductive drums 3C, 3M, and 3K, and then transferred onto the intermediate transfer belt 41.

Figure 4:
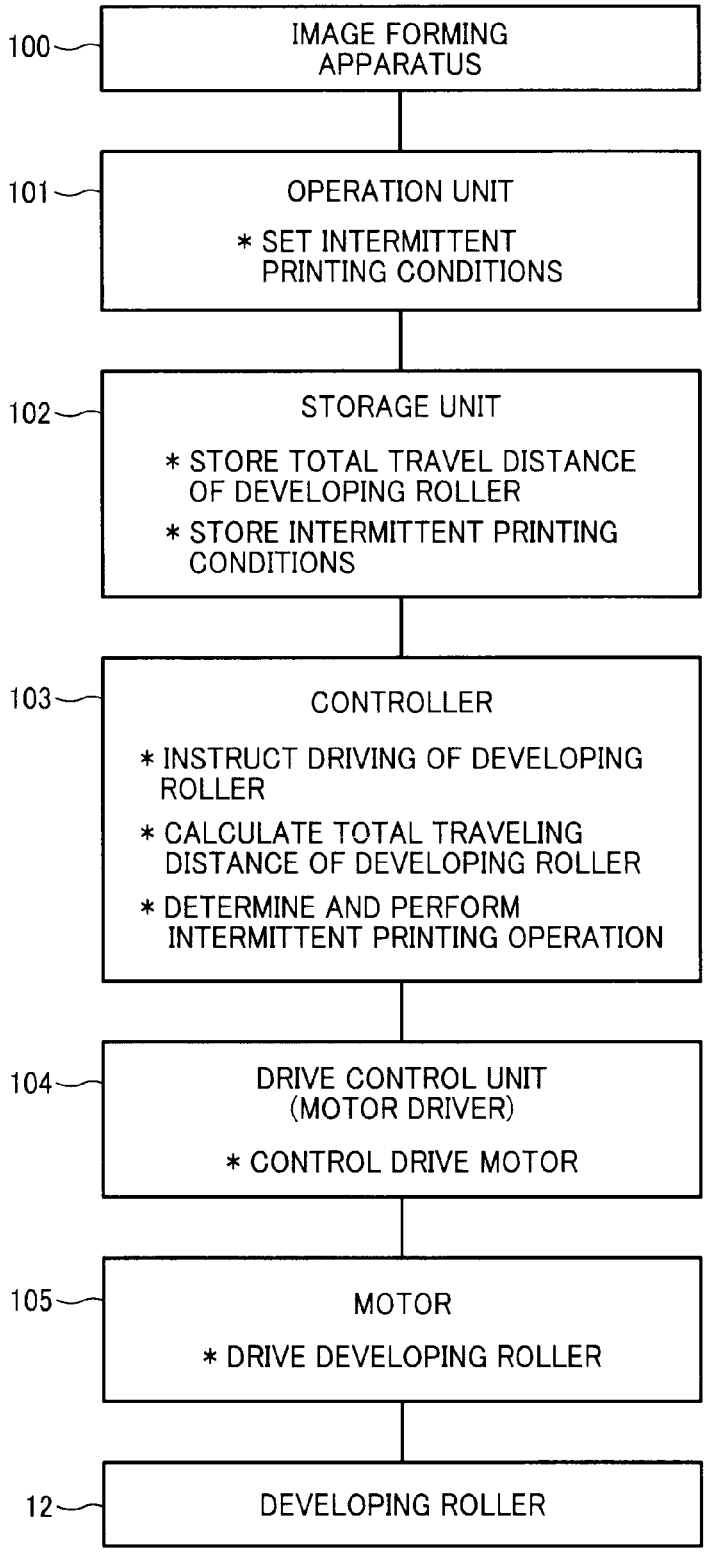
FIG. 4 is a block diagram of image forming control system according to an illustrative embodiment of the present invention.

With reference to FIG. 4, a description is provided of control of the image forming apparatus 100. FIG. 4 is a block diagram of an image forming control system according to an illustrative embodiment of the present invention.

The image forming apparatus 100 includes an operation unit 101 that receives an instruction from outside the image forming apparatus 100. According to the illustrative embodiment, conditions for intermittent printing are set in the operation unit 101. The operation unit 101 is connected to a storage unit 102 that stores a cumulative travel distance of the developing roller 12 at predetermined timing, a total travel distance of the developing roller 12, and the conditions for the intermittent printing. The storage unit 102 is provided to a control circuit in the image forming apparatus 100. The storage unit 102 is connected to a controller 103.

The controller 103 includes a processor and instructs operation of the developing roller 12, calculates the total travel distance of the developing roller 12 and a difference between the total travel distance of the developing roller 12 and the cumulative travel distance of the developing roller at predetermined timing, and authorizes and control the intermittent printing when the difference is equal to or greater than a threshold distance. The controller 103 is provided to the control circuit in the image forming apparatus 100. The controller 103 is connected to a motor driver 104 serving as a drive controller that controls a motor 105 serving as a driving device. The motor driver 104 is connected to the motor 105. Driving the motor 105 enables the developing roller 12 in the developing unit 7 to rotate.

According to the illustrative embodiment, the image forming apparatus 100 detects the printing operation of the developing unit 7. Based on the driving time and the linear velocity of the developing roller 12 during printing, the travel distance of the developing roller 12 is calculated and summed. Subsequently, a cumulative travel distance of the developing roller 12 is stored in the storage unit 102 at predetermined timing, for example, every 5 minutes.

As the cumulative travel distance of the developing roller 12 is stored every 5 minutes, the controller 103 calculates a difference between a most recent value and a value a predetermined time ago, for example, 100 minutes ago. In such a case, the difference between the most recent value and the value 100 minutes ago is calculated. In a case in which the difference exceeds a predetermined threshold travel distance, the intermittent printing is started in accordance with the intermittent printing conditions stored in the storage unit 102.

The predetermined time and the threshold travel distance are stored in the storage unit 102, and are set arbitrarily via the operation unit 101. After a certain time period elapses, for example, after 4 hours from the start of intermittent printing, it is assumed that the temperature of the developing unit 7 is dropped, and hence the controller 103 cancels intermittent printing and enables continuous printing.

Figure 5:
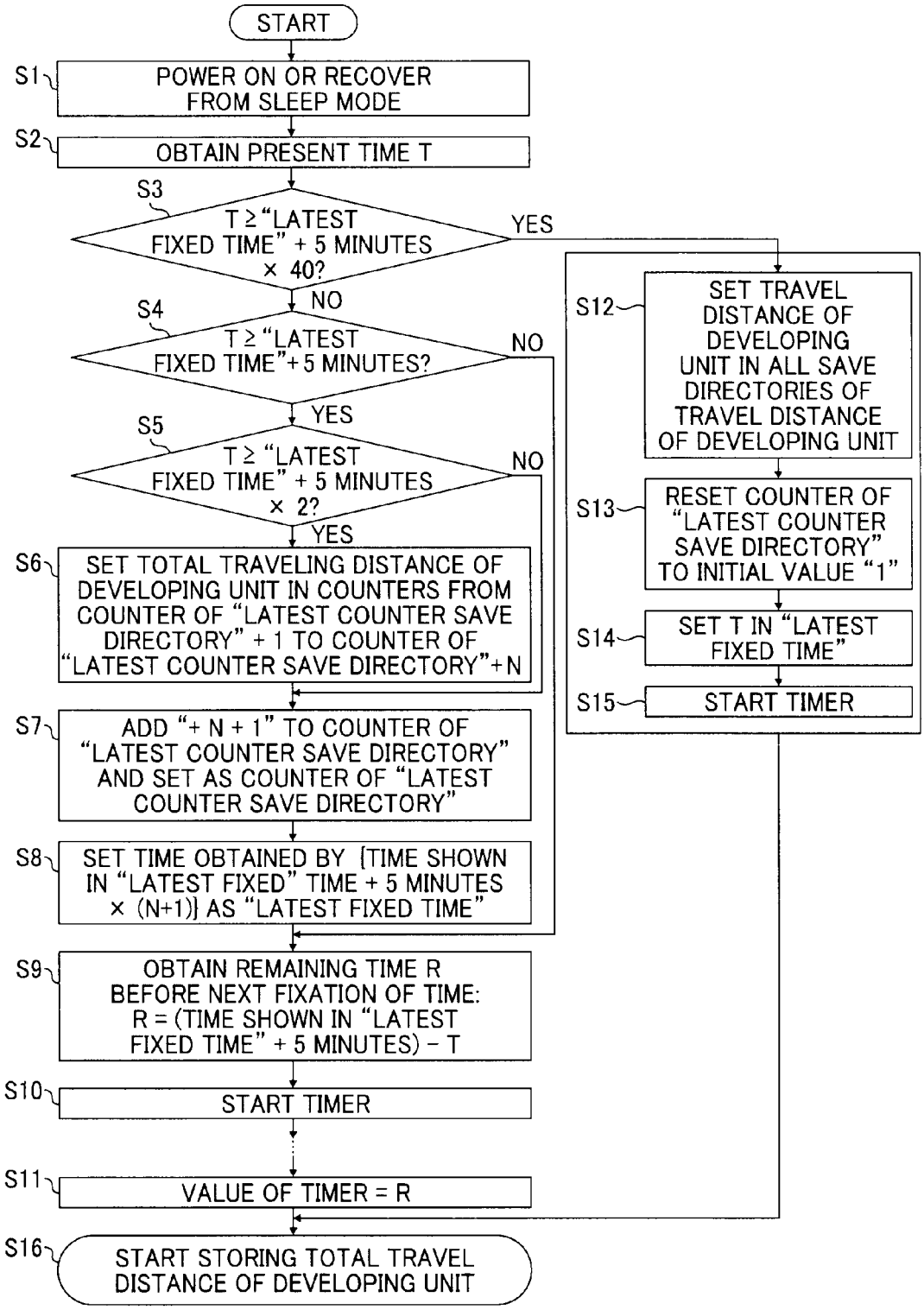
FIG. 5 is a flowchart showing steps in storing a total travel distance of a developing unit employed in the image forming apparatus of FIG. 1 after the power is on according to the illustrative embodiment.

With reference to FIG. 5, a description is provided of steps in storing the total travel distance of the developing unit 7. FIG. 5 is a flowchart showing steps in storing the total travel distance of the developing unit 7 of the image forming apparatus 100 after the power is turned on according to the illustrative embodiment.

As shown in FIG. 5, in a case in which the power of the image forming apparatus 100 is OFF or in a sleep mode and hence printing is halted, when the power is turned on or printing is resumed at Step 1 (S1), the present time T is obtained at Step 2 (S2). Whether or not the obtained time T is a time after a minimum divided time has elapsed from the latest fixed time is determined at Step 4 (S4).

If the obtained time T is a time after the minimum divided time has elapsed from the latest fixed time, whether or not the obtained time is a time after the divided time multiplied by 2 is determined at Step 5 (S5). Subsequently, if it is determined that the obtained time T is a time after the minimum divided time multiplied by 2 has elapsed from the current fixed time (YES at S5), a total travel distance of the developing unit 7 is set in counters from a counter of "LATEST COUNTER SAVE DIRECTORY" to which 1 is added ("LATEST COUNTER SAVE DIRECTORY"+1) to a counter of "LATEST COUNTER SAVE DIRECTORY" to which N is added ("LATEST COUNTER SAVE DIRECTORY"+N) at Step 6 (S6).

It is to be noted that the value N is a truncated value having no decimals obtained in accordance with the following equation:

{Obtained current time *T*−("LATEST FIXED TIME"+5 minutes)}/5.

Subsequently, "+N+1" is added to the counter of "LATEST COUNTER SAVE DIRECTORY", and the value is set as "LATEST COUNTER SAVE DIRECTORY" at Step 7 (S7). Then, the time obtained by {time shown in "LATEST FIXED TIME"+5 minutes×(N+1)} is set as "LATEST FIXED TIME" at Step 8 (S8).

If NO at Step 4 (S4) and Step 5 (S5), the same process is performed.

Next, at Step 9 (S9), a remaining time R before the next fixation of time is obtained by the following equation:

*R*=(time shown in "LATEST FIXED TIME"+5 minutes)−*T*.

Then, a timer is started at Step 10 (S10). When the value of the timer reaches the remaining time R at Step 11 (S11) and the timer is stopped, storing of the total travel distance of the developing unit 7 is initiated at Step 16 (S16).

If the obtained time T indicates that equal to or more than a maximum total time for storing the travel distance of the developing unit (for example, 200 minutes according to the present embodiment) has elapsed, the total travel distance of the developing unit 7 is set in save directories of total travel distance of the developing unit 7 at Step 12 (S12).

Subsequently, "LATEST COUNTER SAVE DIRECTORY" is reset to an initial value "1" at Step 13 (S13), and then the obtained present time T is set in "LATEST FIXED TIME" at Step 14 (S14). Similar to Step 10 (S10), a timer is started at Step 15 (S15). Accordingly, a time period during which the developing unit 7 is halted is obtained from the difference between the latest fixed time and the obtained time T. The same total travel distance of the developing unit 7 for the time period is stored. With this configuration, when obtaining the difference between the two points, the travel distance is 0. Therefore, it is understood that the developing unit 7 is not operated.

Figure 6:
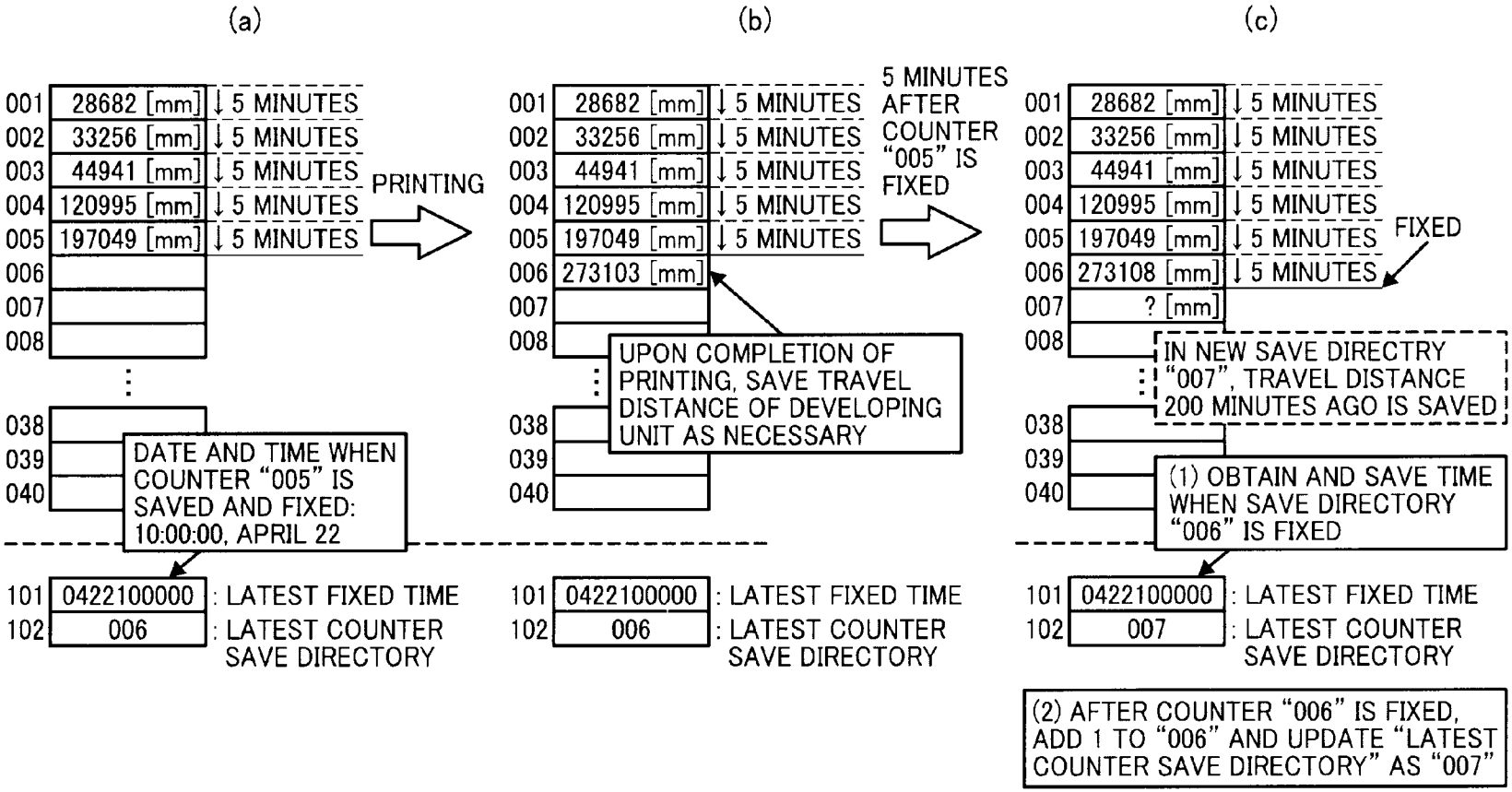
FIGS. 6 (*a*) through 6 (*c*) are schematic diagrams for explaining storing of the total travel distance of the developing unit during printing according to an illustrative embodiment of the present invention.

With reference to FIGS. 6 (*a*) through (*c*), a description is provided of storing of the total travel distance of the developing unit 7 during printing according to the illustrative embodiment. FIGS. 6 (*a*) through (*c*) are schematic diagrams illustrating operation of storing of the total travel distance of the developing unit 7.

First, as illustrated in FIG. 6 (*a*), the latest fixed time T upon start is obtained, and "LATEST COUNTER SET DIRECTORY" is set. As illustrated in FIG. 6 (*b*), the total travel distance of the developing unit 7 is saved as necessary in the address shown in "LATEST COUNTER SAVE DIRECTORY", that is, the counter 006, upon completion of printing from "LATEST FIXED TIME" until the divided time of 5 minutes elapses. Subsequently, as illustrated in FIG. 6 (*c*), the value in the counter is fixed when the divided time of 5 minutes elapses. The time in "LATEST FIXED TIME" is overwritten with the present time, and then "LATEST COUNTER SAVE DIRECTORY" proceeds by one. Accordingly, "LATEST COUNTER SAVE DIRECTORY" becomes the counter 007 in which the total travel distance 200 minutes ago (the predetermined time ago) is set as the condition for the intermittent printing. In this configuration, the divided time which is specified as the intermittent printing condition is updated every 5 minutes according to the present embodiment. The total travel distance of the developing unit 7 of the image forming apparatus 100 during printing is stored in the storage unit 102.

Figure 7A:
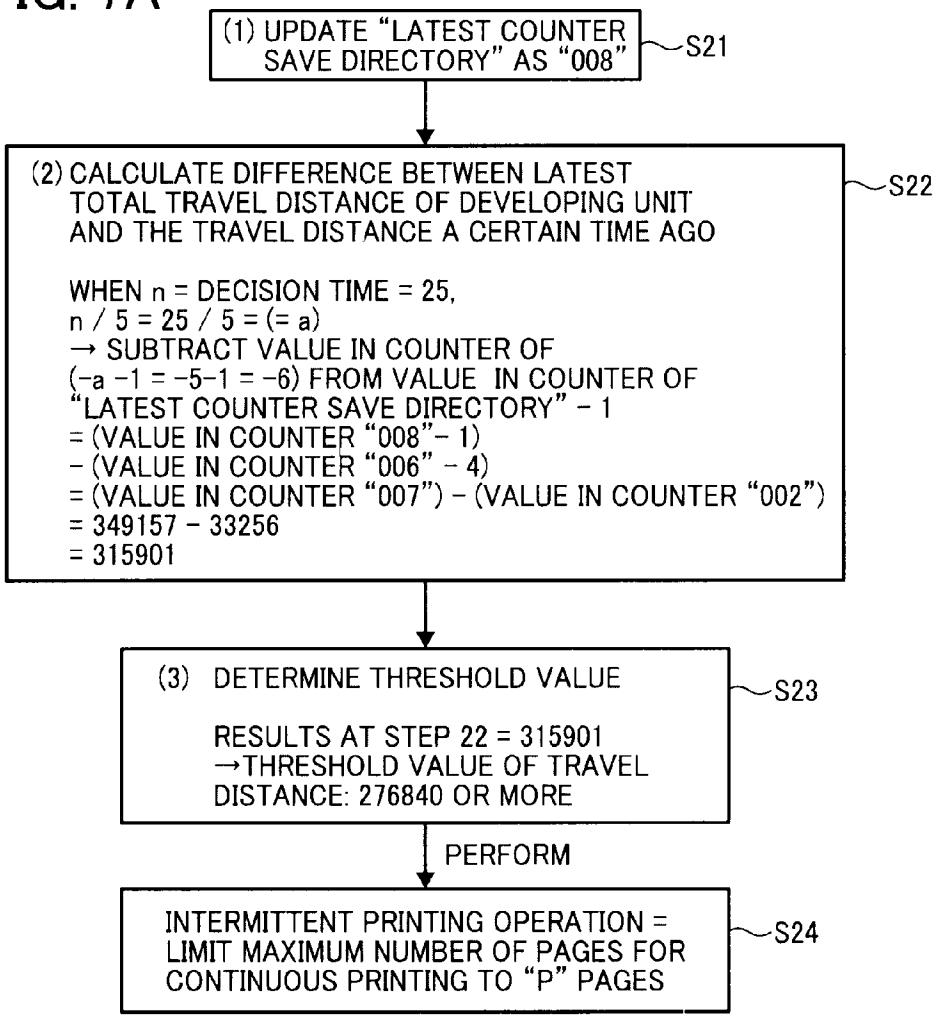
FIG. 7A is a flowchart showing steps in determination of intermittent printing.
Figure 7B:
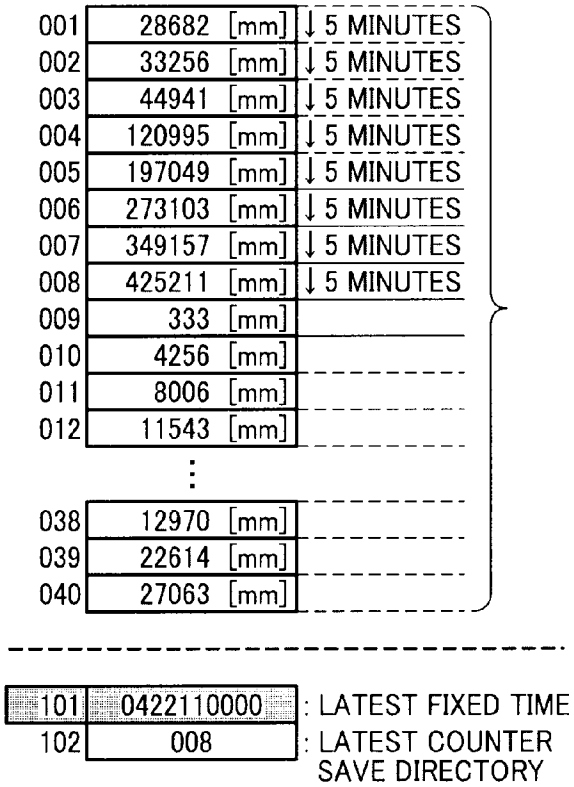
FIG. 7B is a table showing an example of counters, the travel distance of the developing unit, and time.

With reference to FIGS. 7A and 7B, a description is provided of determination of the intermittent printing. FIG. 7A is a flowchart showing steps in determination of the intermittent printing. FIG. 7B is a table used at Step 22 of FIG. 7A, showing an example of the counters and time continued from FIG. 6. Assuming that the divided time as shown in FIG. 6 elapses, following the counter 007 shown in FIG. 6, "LATEST COUNTER SAVE DIRECTORY" is updated as 008 at Step 21 (S21). The difference between the latest total travel distance of the developing unit 7 and the travel distance a predetermined time ago which is set as a "decision time" is calculated at Step 22 (S22).

If the difference exceeds a threshold value for the travel distance at Step 23 (S23), the intermittent printing is instructed, that is, a number of pages continuously printed out (maximum pages P) is limited at Step 24 (S24). As a result, when P is 1, even when printing of a plurality of pages is instructed, continuous printing is not performed, but instead, intermittent printing is performed. In the intermittent printing, the following sequence of operation is performed: 1) initialization of driving of the developing unit, 2) printing one page, 3) halting driving of the developing unit, and returning to the sequence 1).

With this configuration, problems caused by undesirable increase in the temperature of the image forming apparatus 100, parts in the developing unit 7, toner in the developer stored in the developing unit 7, and so forth can be prevented during continuous printing. More specifically, melting of toner and the like is prevented. When toner and the like are melted and solidified when cooled, a rotary shaft of the developing roller 12 is fixed, hindering rotation of the rotary shaft.

If the start time of the intermittent printing is stored and 4 hours, for example, have elapsed since the start of the intermittent printing, it is assumed that the predetermined time specified as a condition for the intermittent printing has elapsed. Therefore, it is considered that the temperature of the developing unit 7 has decreased sufficiently, and the subsequent intermittent printing is thus canceled.

According to the illustrative embodiment, even when continuous printing of multiple pages is instructed, intermittent printing is performed for a predetermined time period so that a rest time of the developing unit is increased and hence undesirable temperature increase in the developing unit is prevented without a designated temperature detector.

According to the illustrative embodiment of the present invention, based on a drive time of a developing roller and its linear velocity, a total travel distance of the developing unit is calculated and stored every 5 minutes for 200 minutes, for example. A difference between the latest travel distance and the total travel distance stored 100 minutes ago is calculated so that the latest travel distance for the last 100 minutes is obtained.

If the difference is equal to or greater than the permissible travel distance, it is assumed that the temperature is close to a maximum permissible temperature, and hence intermittent printing is performed for a certain period of time even when continuous printing is requested, thereby increasing a rest time of the developing device and preventing temperature rise.

According to the illustrative embodiment, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear a latent image on a surface thereof;

a developing unit including a developing roller facing the image bearing member, to develop the latent image formed on the image bearing member using toner to form a toner image;

a driving unit to drive the developing roller;

a controller to calculate a cumulative travel distance of the developing roller, the cumulative travel distance is based on a driving time of the driving unit and a linear velocity of the developing roller; and a storage unit connected to the controller, stores the cumulative travel distance at predetermined intervals;

wherein the controller obtains a difference between a most recent value of the cumulative travel distance and a previous value of the cumulative travel distance, which is stored a predetermined time ago prior to the most recent value, and wherein when the difference is equal to or greater than a threshold travel distance, the controller instructs the driving unit to perform an intermittent printing in which continuous printing is limited to a certain number of pages including printing at least one page, in a predetermined time period.

2. The image forming apparatus according to claim 1, wherein a predetermined point in time at which the cumulative travel distance is obtained is changeable.

3. The image forming apparatus according to claim 1, wherein the threshold travel distance is changeable.

4. The image forming apparatus according to claim 1, the number of pages to be continuously printed in the intermittent printing is changeable.

5. The image forming apparatus according to claim 1, wherein a threshold elapsed time from start of the intermittent printing to cancel the intermittent printing is changeable.

6. The image forming apparatus according to claim 1, wherein the storage unit stores the time of start of intermittent printing.

7. The image forming apparatus according to claim 1, wherein a minimum time period from when driving of the developing roller stops to when the developing roller resumes is changeable.

8. The image forming apparatus according to claim 1, further comprising:

an operation unit in which control conditions are set, wherein the control conditions include at least one of a predetermined point in time in the image forming operation and the threshold travel distance, and the storage unit stores the control conditions.

9. The image forming apparatus according to claim 1, wherein the total travel distance of the developing roller is equal to or greater than the cumulative travel distance of the developing roller at predetermined timing.

10. The image forming apparatus according to claim 1, wherein the threshold travel distance is a limit value which is given from a limit number of pages continuously printed out.

11. An image forming apparatus, comprising:

means for bearing a latent image;

means for developing the latent image using toner to form a toner image, including a developing roller facing the image bearing means;

means for driving the developing roller;

means for controlling that calculates a cumulative travel distance of the means for developing, the cumulative travel distance is based on a driving time of the means for driving and a linear velocity of the developing roller;

means for storing connected to the means for controlling, the means for storing stores the cumulative travel distance at predetermined intervals;

wherein the means for controlling obtains a difference between a most recent value of the cumulative travel distance and a previous value of the cumulative travel distance, which is stored a predetermined time ago prior to the most recent value, and wherein when the difference is equal to or greater than a threshold travel distance, the means for controlling instructs the means for driving to perform an intermittent printing in which continuous printing is limited to a certain number of pages including printing at least one page in a predetermined time period.

12. The image forming apparatus according to claim 11, wherein a predetermined point in time at which the cumulative travel distance is obtained is changeable.

13. The image forming apparatus according to claim 11, wherein the threshold travel distance is changeable.

14. The image forming apparatus according to claim 11, wherein the number of pages to be continuously printed in the intermittent printing is changeable.

15. The image forming apparatus according to claim 11, wherein a threshold elapsed time from start of the intermittent printing to cancel the intermittent printing is changeable.

16. The image forming apparatus according to claim 11, wherein the storing means stores the time of start of intermittent printing.

17. The image forming apparatus according to claim 11, wherein a minimum time period from when driving of the developing roller stops to when the developing roller resumes is changeable.

18. The image forming apparatus according to claim 11, further comprising:

an operation unit in which control conditions are set, wherein the control conditions include at least one of a predetermined point in time in the image forming operation and the threshold travel distance, and the means for storing stores the control conditions.

19. The image forming apparatus according to claim 11, wherein the total travel distance of the developing means is equal to or greater than the cumulative travel distance of the developing means at predetermined timing.

20. The image forming apparatus according to claim 11, wherein the threshold travel distance is a limit value which is given from a limit number of pages continuously printed out.

21. An image forming method for forming an image, the method comprising:

bearing a latent image;

developing the latent image using toner to form a toner image;

driving a developing unit that includes a developing roller;

calculating a cumulative travel distance of the developing roller, the cumulative travel distance is based on a driving time of the driving of the developing unit and a linear velocity of the developing roller;

storing the cumulative travel distance at predetermined intervals;

obtaining a difference between a most recent value of the cumulative travel distance and a previous value of the cumulative travel distance, which is stored a predetermined time ago prior to the most recent value; and when the difference is equal to or greater than a threshold travel distance, instructing an intermittent printing in which continuous printing is limited to a certain number of pages including printing at least one page in a predetermined time period.

22. The image forming method for forming an image according to claim 21, wherein the threshold travel distance is a limit value which is given from a limit number of pages continuously printed out.

* * * * *